US009670627B1

(12) United States Patent
Schaeding et al.

(10) Patent No.: US 9,670,627 B1
(45) Date of Patent: Jun. 6, 2017

(54) THREE-DIMENSIONAL FINISHING MACHINE

(71) Applicant: GOMACO Corporation, Ida Grove, IA (US)

(72) Inventors: Chad Schaeding, Ida Grove, IA (US); Mark W. Brenner, Ida Grove, IA (US); Raymond J. Bumann, III, Ida Grove, IA (US)

(73) Assignee: GOMACO Corporation, Ida Grove, IA (US)

( * ) Notice: Subject to any disclaimer, the term of this patent is extended or adjusted under 35 U.S.C. 154(b) by 115 days.

(21) Appl. No.: 14/806,308

(22) Filed: Jul. 22, 2015

Related U.S. Application Data

(60) Provisional application No. 62/027,670, filed on Jul. 22, 2014.

(51) Int. Cl.
*E01C 19/22* (2006.01)

(52) U.S. Cl.
CPC ..... *E01C 19/22* (2013.01)

(58) Field of Classification Search
CPC ..... E01C 19/22; E01C 19/48; E01C 19/004; E02F 9/20; E02F 9/2025; E02F 5/00
USPC ..... 404/84.8
See application file for complete search history.

(56) References Cited

U.S. PATENT DOCUMENTS 2,923,254 A 2/1960 Barthelmess
4,484,834 A * 11/1984 Rowe ..... E01C 19/38 404/119
4,699,543 A * 10/1987 Mio ..... E02B 5/02 404/104
4,801,219 A * 1/1989 Yazawa ..... E02D 3/039 404/125
4,852,278 A * 8/1989 Takizawa ..... E02F 9/2025 37/197
4,861,189 A * 8/1989 Fukukawa ..... E01C 19/004 404/127
4,970,800 A * 11/1990 Takizawa ..... E02F 9/2025 172/4.5
6,109,825 A * 8/2000 Yon ..... E01C 19/008 404/84.05
6,588,976 B2 * 7/2003 Quenzi ..... E04F 21/245 404/101
7,198,429 B2 * 4/2007 LeJeune ..... B28B 13/0295 404/118
8,459,898 B2 6/2013 Guntert, Jr. et al.
9,051,696 B1 6/2015 Coats et al.
(Continued)

*Primary Examiner* — Abigail A Risic
(74) *Attorney, Agent, or Firm* — Suiter Swantz pc llo

(57) ABSTRACT

An apparatus and method for finishing or texturing a paved surface including one or more transition curves includes a finishing machine with a transverse frame including a series of flexibly connected frame members and one or more power transition adjusters. As the finishing machine proceeds through the transition curve, the control system and sensors of the finishing machine determine its position and the transverse curvature of the paved surface corresponding to its position. The control system may then adjust the position of accessories mounted to the transverse frame via a combination of raising or lowering the accessories relative to the paved surface and articulating the one or more power transition adjusters to adjust the shape of the transverse frame to conform to the transverse curvature of the paved surface.

17 Claims, 6 Drawing Sheets

(56) References Cited

U.S. PATENT DOCUMENTS

| | | | | |
|---|---|---|---|---|
| 9,180,909 | B1 | 11/2015 | Coats et al. | |
| 9,359,727 | B2 | 6/2016 | Guntert, Jr. et al. | |
| 9,404,228 | B1 | 8/2016 | Coats et al. | |
| 2011/0150572 | A1* | 6/2011 | Fritz | E01C 19/004 404/72 |
| 2016/0208446 | A1* | 7/2016 | Vogel | E01C 19/4873 |
| 2016/0251042 | A1 | 9/2016 | Guntert, Jr. et al. | |
| 2016/0305075 | A1* | 10/2016 | Thieme | E01C 19/004 |

* cited by examiner

THREE-DIMENSIONAL FINISHING MACHINE

CROSS-REFERENCE TO RELATED APPLICATIONS

The present application claims the benefit under 35 U.S.C. §119(e) of U.S. Provisional Patent Application Ser. No. 62/027,670, filed Jul. 22, 2014. The present application is related to U.S. patent application Ser. No. 14/172,461, filed Feb. 4, 2014, which issued on Jun. 9, 2015 as U.S. Pat. No. 9,051,696. Said applications are herein incorporated by reference in their entirety.

TECHNICAL FIELD

The present disclosure is directed generally toward paving and finishing machines, and more particularly toward finishing machines configured to produce a paved surface including one or more transition curves.

BACKGROUND

A paved surface designed for high speed travel, such as a highway or racetrack, may incorporate banked curves in which the roadway slopes downward from the outside edge of the curve toward the inside edge, thereby directing the normal force on vehicles traveling through the curve inward, providing additional centripetal force and reducing the importance of friction between their wheels and the surface to keep said vehicles on course through the curve. Such a banked curve may reflect a constant radius from a constant center point, and a constant downslope.

In order to avoid sudden changes in lateral acceleration between banked curves and level surfaces (where there is no lateral acceleration), the paved surface may incorporate transition curves, which provide a smooth transition from level highway to banked curve and back again. A paving or texturing machine may incorporate hydraulic actuators to raise or lower the superstructure of the machine relative to the surface. However, the degree of superelevation necessary for a banked curve or a transition curve (i.e., the difference in height between the outside and inside edges of the curve) may exceed the capacity of hydraulic actuators to vertically articulate the machine. In addition, while a portion of a paved surface incorporating a banked curve may require a constant downslope, a transition curve seamlessly connecting a substantially flat (i.e., zero slope) surface with a downsloping banked curve may require a downslope that changes from point to point along the transverse axis of the curve, or a downslope that changes along the transverse axis of the paved surface. In the latter case, raising or lowering the rigid, linear transverse frame of the finishing machine via hydraulic actuators is not a viable solution. The use of power transition adjusters is known in the art to bend the rigid frame of the paving or finishing machine; e.g., to raise the centerpoint of the machine so that the paved surface can be crowned. However, such a configuration also fails to solve the problem of texturing a transition curve of continually or nonlinearly changing downslope or transverse curve. It may therefore be desirable to provide an efficient means of finishing or texturing a continuous paved surface including one or more transition curves. It may further be desirable to provide a single efficient means of finishing or texturing a continuous paved surface including both transition curves and more gradually sloped surfaces.

SUMMARY

In a first aspect, embodiments of the present disclosure are directed to an apparatus for finishing a paved surface including transition curves whose parameters may continually change in three dimensions. The apparatus may include a control system configured to store a surface profile including a first position of the apparatus relative to the paved surface and a slope or curvature of the surface. The apparatus may include a position sensor configured to sense a position of the apparatus, and end cars on both the inside and outside edges of the paved surface. The end cars may be connected by a transverse frame including a plurality of frame members flexibly connected in series by power transition adjusters. The apparatus may include an undercarriage slidably coupled to the transverse frame and including height adjusters and a cylinder finisher or accessory. The control system may compare the sensed position of the apparatus to the surface profile and, based on the comparison, adjust the position of the accessory relative to the paved surface via a combination of raising or lowering the undercarriage via the height adjusters and adjusting the shape of the transverse frame to conform to a transverse curvature by actuating the power transition adjusters and bending the frame.

In a further aspect, embodiments of the present disclosure are directed to a method for finishing a paved surface with a finishing machine having a transverse frame. The method may include: loading a surface profile corresponding to the paved surface into a data storage unit coupled to a control system of the finishing machine, the surface profile including at least one of a position of the finishing machine relative to the paved surface, a slope of the paved surface, and a transverse curvature of the paved surface; sensing at least one position of the finishing machine via a position sensor of the finishing machine; comparing the sensed position of the finishing machine with the surface profile via the control system; adjusting the position of at least one accessory relative to the paved surface based on at least one of the sensed position and the surface profile via a combination of 1) vertically articulating the accessory via height adjusters and 2) laterally articulating the accessory along the transverse frame; and adjusting the shape of the transverse frame to conform to a transverse curvature by articulating at least one power transition adjuster of the finishing machine.

DETAILED DESCRIPTION

Features of the inventive concepts disclosed herein in their various embodiments are exemplified by the following descriptions with reference to the accompanying drawings, which describe the inventive concepts with further detail. It is to be understood that both the foregoing general description and the following detailed description are exemplary and explanatory only, and are not necessarily restrictive of the inventive concepts disclosed and claimed herein. These drawings depict only exemplary embodiments of the inventive concepts, and should not be considered to limit their scope in any way.

Figure 1:
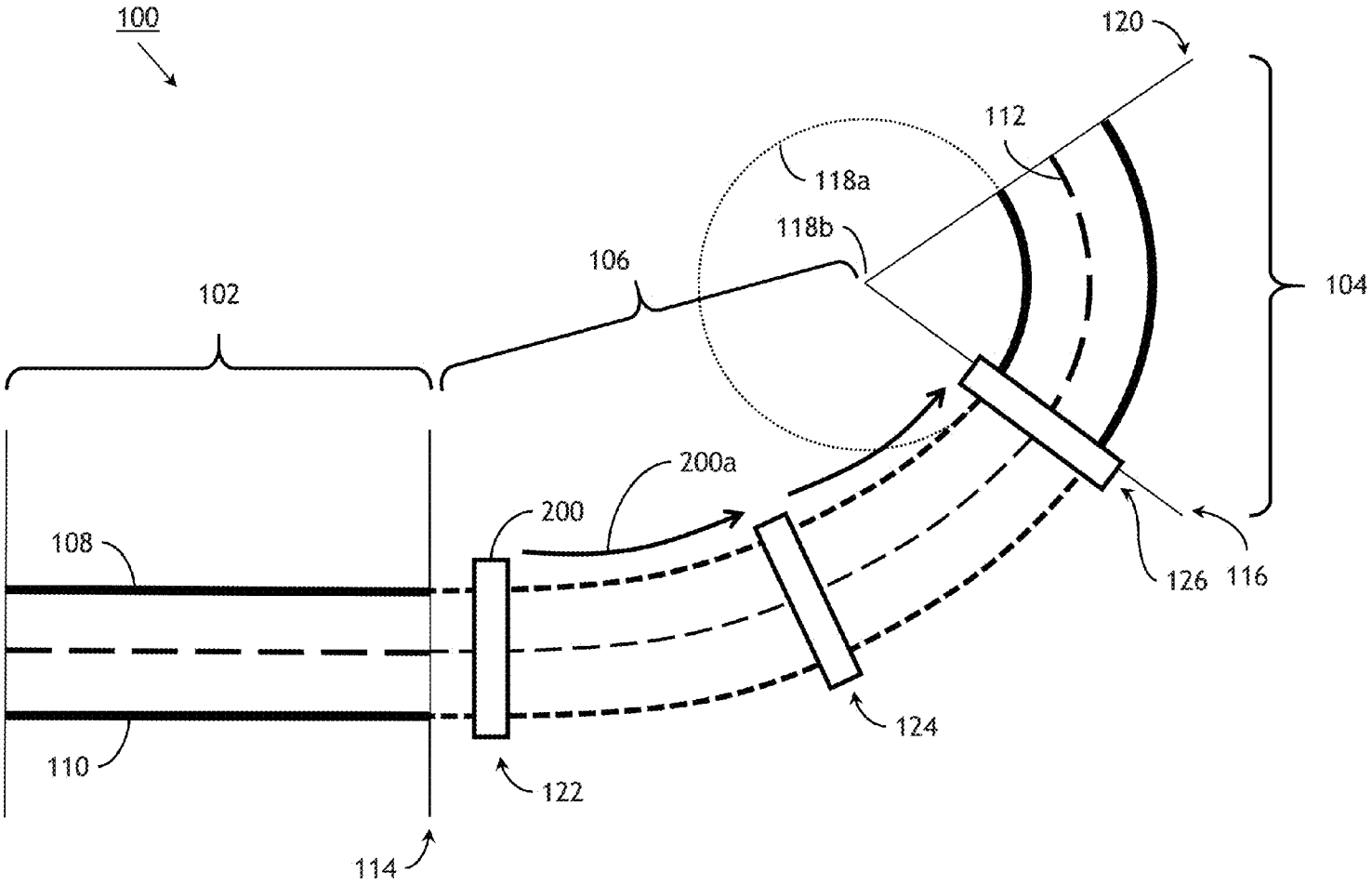
FIG. 1 is a diagrammatic illustration of a paved surface including a transition curve.

Referring to FIG. 1, a segment of a recently paved surface 100 may include a relatively straight, level portion 102, a banked curve 104, and a transition curve 106 connecting the level portion 102 to the banked curve 104. With respect to the banked curve 104 and the transition curve 106, the paved surface 100 may have an inside edge 108 and an outside edge 110 relative to its centerline 112, representing the inside and outside edges of the transition curve 106 and the banked curve 104. At point 114, where the transition curve 106 begins, the paved surface is still substantially flat and of zero slope, as in its straight, level portion 102. As the inside edge 108 and outside edge 110 of the paved surface 100 are at substantially the same height (ex.—altitude) at point 114, there is not only substantially zero slope but zero superelevation. Throughout the transition curve 106, the superelevation of the paved surface 100 may then increase as the outside edge 110 rises above the inside edge 108 due to curve banking. At point 116, therefore, the transition curve 106 is nearly identical to the banked curve 104 in that the superelevation of the paved surface 100, as well as the slope of the paved surface 100, is at or near maximum. The banked curve 104 may represent a constant curve of fixed radius (relative to circle 118*a* and centerpoint 118*b*). Therefore from point 116 to point 120, the superelevation and slope of the banked curve 104 may remain constant. Beyond point 120, the paved surface 100 may enter a second transition curve reflecting the transition of the banked curve 108 to an additional straightaway or an additional banked curve. Points 122, 124, and 126 represent orientations of a finishing machine 200 as the finishing machine 200 proceeds along the paved surface 100 (200*a*) in a direction substantially corresponding to the centerline 112.

Figure 2A:
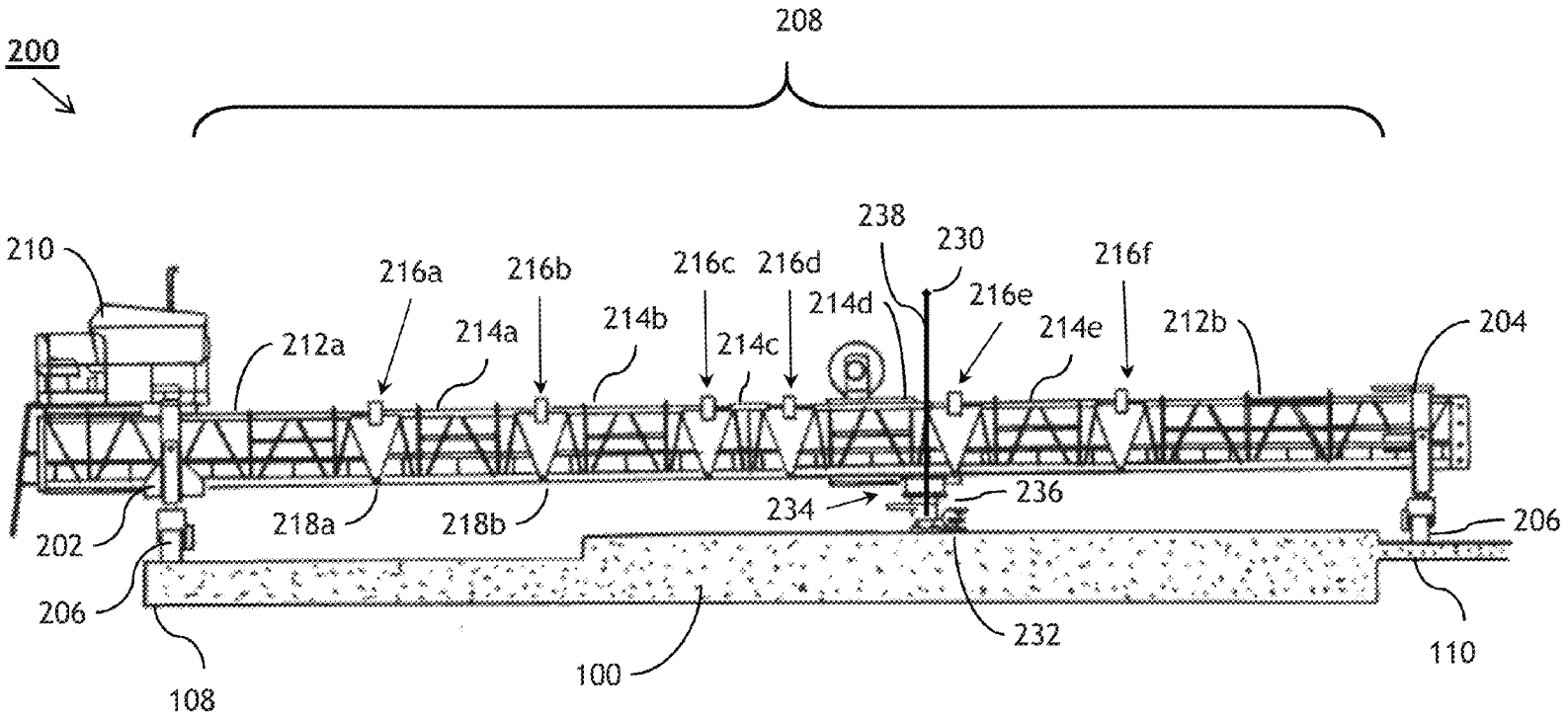
FIGS. 2A, 2B, and 2C are forward environmental views of a finishing machine and a paved surface according to embodiments of the present disclosure.

Referring also to FIG. 2A, at a point 122 where the finishing machine 200 has just entered the transition curve 104, the configuration of the finishing machine 200 may generally reflect the nearly zero slope and transverse curvature of the paved surface 100 at point 122. In one embodiment, a finishing machine 200 according to the present disclosure includes two end cars, an inside end car 202 on the inside edge 108 of the paved surface 100 and an outside end car 204 on the outside edge 110 of the paved surface 100. The end cars 202 and 204 may contact the paved surface 110 via one or more steerable crawlers 206, which propel the finishing machine 200 forward through the transition curve 106, substantially parallel to the centerline 112.

The inside and outside end cars 202 and 204 may be connected by a transverse frame 208 which extends laterally across the paved surface 100, substantially perpendicular to the edges 108, 110 and to the centerline 112 of the paved surface 100. The end car 202 may be slidably coupled to the transverse frame 208, so that additional frame members 212, 214 may be added to or subtracted from the transverse frame 208. The end cars 202 and 204 may further include one or more hydraulic actuators (not shown) for raising or lowering the transverse frame 208 relative to the paved surface 100. An operating console 210 may be fixed to the transverse frame 208 proximate to the inside end car 202. For example, the operating console 210 may include space for the operator of the finishing machine 200, an input terminal (not shown) for the control system of the finishing machine 200, and a power source (not shown) for the finishing machine 200 and its components.

Figure 3:
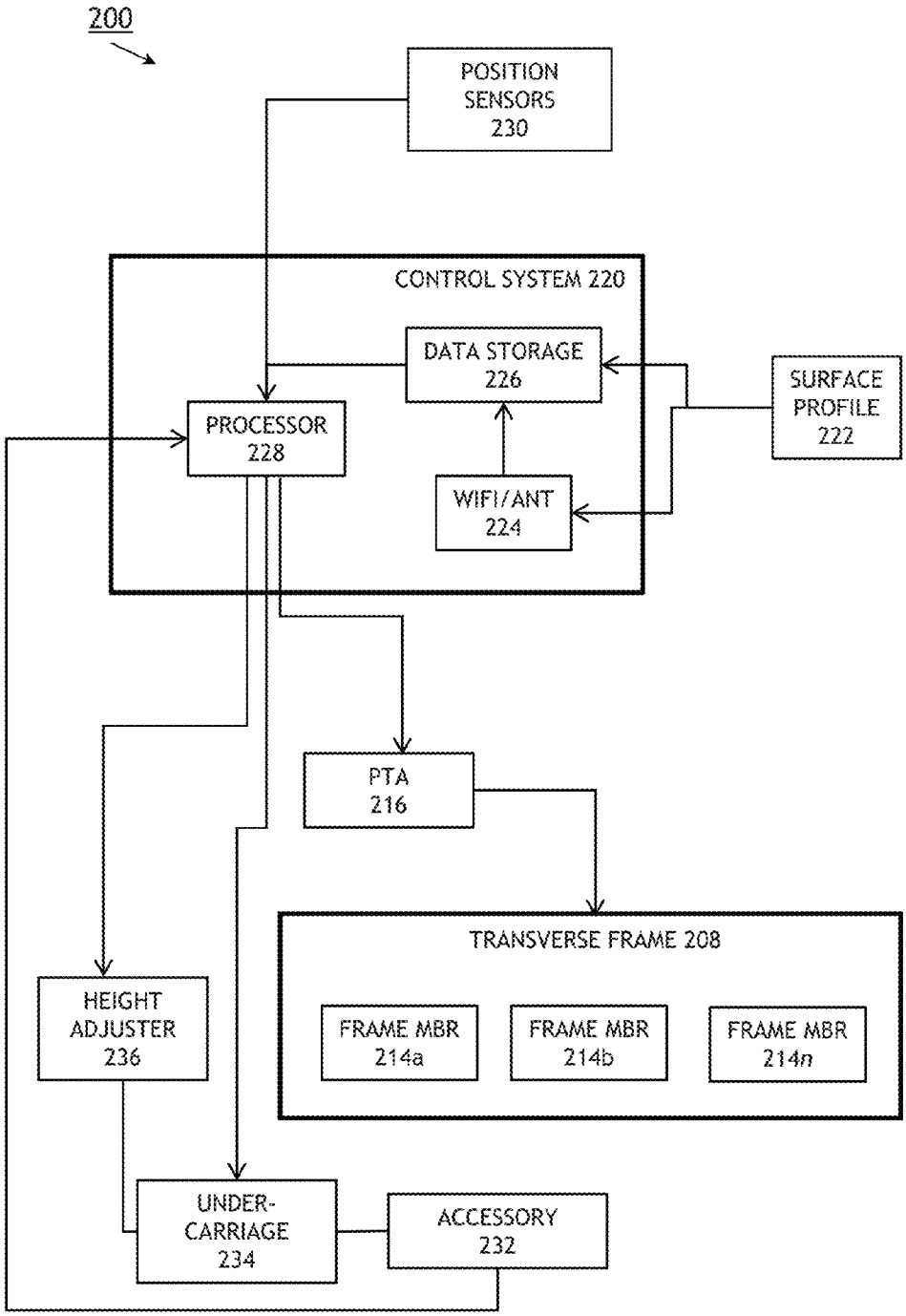
FIG. 3 is a block diagram of a finishing machine according to embodiments of the present disclosure.

The transverse frame 208 of the finishing machine 200 may include rigid frame members 212*a* and 212*b* at either end of the frame, connected to the inside end car 202 and the outside end car 204 respectively. Between the two rigid frame members 212*a* and 212*b*, the transverse frame 208 may comprise a series of flexibly connected frame members 214 coupled to each other by a series of power transition adjusters (PTA) 216. For example, frame member 214*a* may be flexibly or hingedly coupled to the inside rigid frame member 212*a* at point 218*a* by PTA 216*a*, and flexibly or hingedly coupled to a second frame member 214*b* at point 218*b* by PTA 216*b*. The precise number and size of flexibly connected frame members 214 may be determined by 3D computer modeling of the paved surface 100 by the control system 220 of the finishing machine 200. For example, referring also to FIG. 3, the control system 220 may generate a surface profile 222 corresponding to a path of the finishing machine 200 through the transition curve 106 and the banked curve 104, the transverse curvature of the paved surface 100 at every point, and the precise configuration, orientation and activities of the finishing machine 200 at every point along its path. The surface profile 222 may be generated by an external computer or control system and loaded into the control system 220 either physically or via a wireless link or antenna 224. The surface profile may be stored in a memory or other data storage unit 226 of the control system 220. One or more processors 228 of the control system 220 may compare or correlate incoming sensor data with the surface profile 222.

For each position of the finishing machine 200 along its path, the surface profile 222 may include: a projected height of the inside edge 108 and the outside edge 110 of the paved surface 100; a superelevation of the paved surface 100; a representation of the transverse curvature of the paved surface 100, i.e., the slope of the paved surface 100 across a given transverse axis perpendicular to the centerline 112; and a configuration of the finishing machine 200 to match the transverse curvature of the paved surface 100, e.g., so that the paved surface 100 may be finished, cured, or otherwise treated in a consistent and uniform fashion (ex.—at a uniform depth) throughout the transition curve 106. Depending on the precise transverse curvature of the transition curve 106, the surface profile 222 may provide for a configuration of the transverse framework 208 that includes several flexibly connected frame members 214 of uniform size (for example, frame members 214*a*, 214*b*, 214*d* and 214*e*) or frame members 214 of varying sizes (for example, frame member 214*c*) so that the transverse framework 208 may conform to the transverse curvature of the paved surface 100 at any given point.

The finishing machine 200 may include a variety of position sensors 230 configured to determine a position of the finishing machine 200, or of one of its components, and return that position to the control system 220. For example, the operating console 210 may include a GNSS (ex.—GPS, GLONASS, Compass) receiver that continually determines an absolute position (ex.—latitude, longitude, altitude) of the finishing machine 200. The control system 220 may continually compare this absolute position to the surface profile 222 to determine the finishing machine's position along its path. The control system 220 may then determine from the surface profile 222 the transverse curvature of the paved surface 100 corresponding to the position of the finishing machine 200, which may in turn determine whether the control system 220 articulates the PTA 216 to adjust the configuration of the transverse framework 208.

The position sensors 230 of the finishing machine 200 may include a slope sensor 230 mounted to a mast 238 fixed to the transverse frame 208 or to an undercarriage 234 mounted to the underside of the transverse frame 208. For example, the undercarriage 234 may be slidably mounted to the transverse frame 208 via a system of rails on the underside of the transverse frame 208. The control system 220 may then laterally articulate the undercarriage 234 along the transverse curvature of the paved surface 100. As the finishing machine 200 proceeds through the transition curve 106 and the transverse curvature changes, the slope sensor 230 may sense a rotational angle of the finishing machine 200, such as a pitch angle or a roll angle relative to the horizontal. The control system 220 may interpret the orientation of the finishing machine 200 (as determined by the slope sensor 230) as a relative position of the finishing machine 200, relative to a benchmark position of the finishing machine 200 with respect to one or more rotational axes (x, y, z) or to a prior absolute position of the finishing machine 200 as determined by a GNSS receiver or other absolute position sensor 230.

The control system 220 may then compare the orientation of the finishing machine 200 to the surface profile 222 to determine whether to adjust the elevation of one or more accessories 232 fixed to the undercarriage 234. For example, to finish at a uniform depth a paved surface 100 having a relatively shallow slope and little to no transverse curvature, as shown by FIG. 2A, the control system 220 may control the elevation of the accessory 232 by adjusting the height the undercarriage 234 via one or more hydraulic cylinders or like height adjusters (ex.—lift cylinders) 236. For example, the undercarriage 234 may include a front lift cylinder 236 and a rear lift cylinder (not shown) for raising or lowering the elevation of the accessory 232 relative to the paved surface 100, depending on the transverse curvature of the paved surface 100 at that particular point and the position of the finishing machine 200 as determined by the slope sensor 230.

Figure 2B:
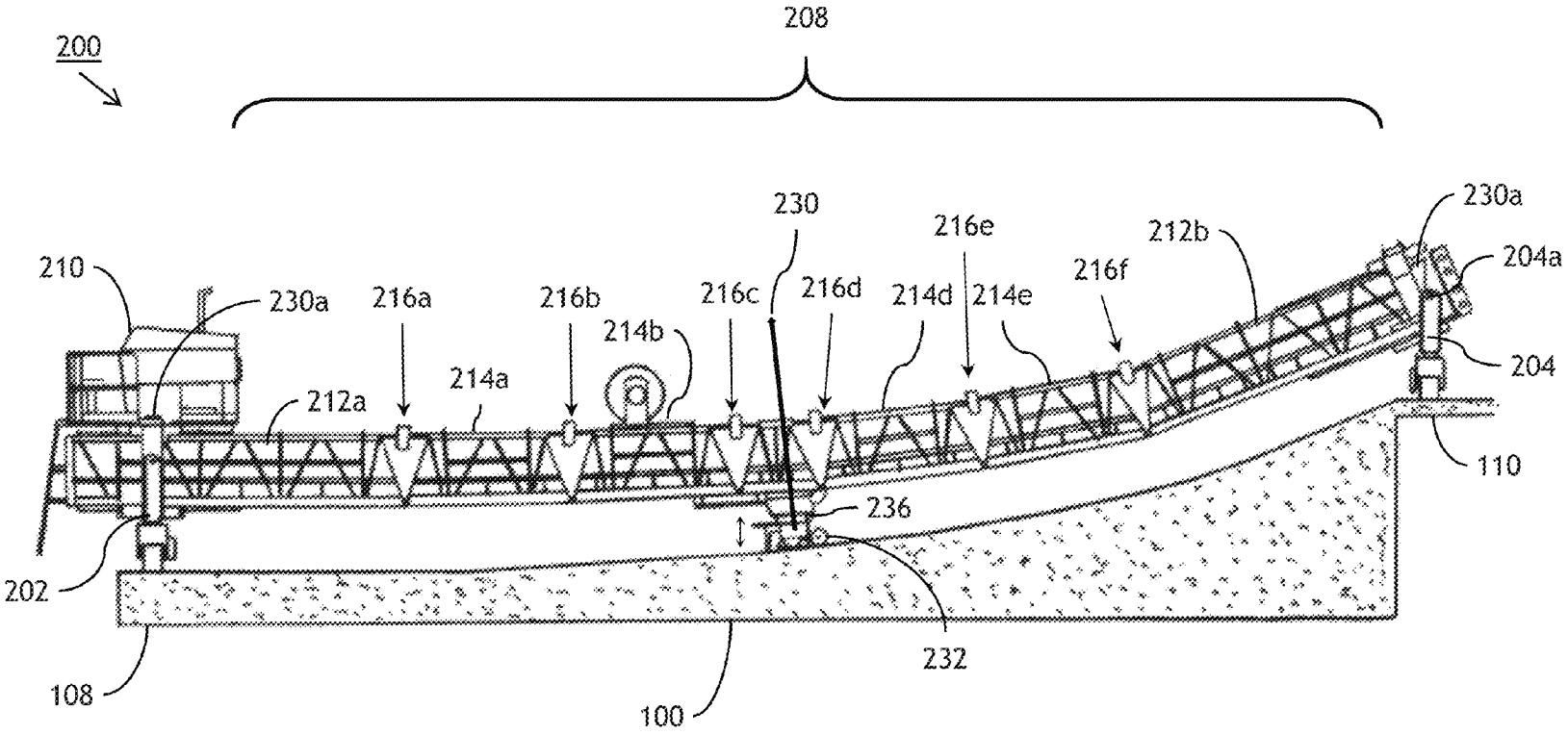

As the finishing machine 230 proceeds through the transition curve 106, the slope or transverse curvature of the paved surface may increase and/or vary widely between the outside edge 110 and the inside edge 108. For example, referring also to FIG. 2B, at a point 124 midway through the transition curve 106, the height of the outside edge 110 of the transition curve 106, and therefore of the outside end car 204, may be significantly greater than that of the inside edge 108 and the inside end car 202 due to curve banking. As the finishing machine 200 reaches point 124, the control system 220 continues to receive updated position information from the position sensors 230 and to correlate this position information with the surface profile 222. As can be seen in FIG. 2B, at a position corresponding to point 124, the transverse slope of the paved surface 100 is much greater than at point 122. The transverse slope of the paved surface 100, however, may not be consistent, reflecting the transverse curvature of the paved surface 100. In addition to controlling the precise height of the accessory 232 by raising or lowering the undercarriage 234 via the height adjusters 236, the control system may actuate one or more of the power transition adjusters 216*a* . . . 216*f*, bending the shape of the transverse frame 208 to conform to the correct transverse curvature. For example, PTAs 216*e* and 216*f* may be actuated due to the steeper transverse curvature nearer the outside edge 110. However, nearer the inside edge 108 the slope is more gradual, so PTAs 216*a* and 216*b* may remain relatively stable while the control system 220 may match the transverse curve by vertically adjusting the elevation of the accessory 232.

Figure 2C:
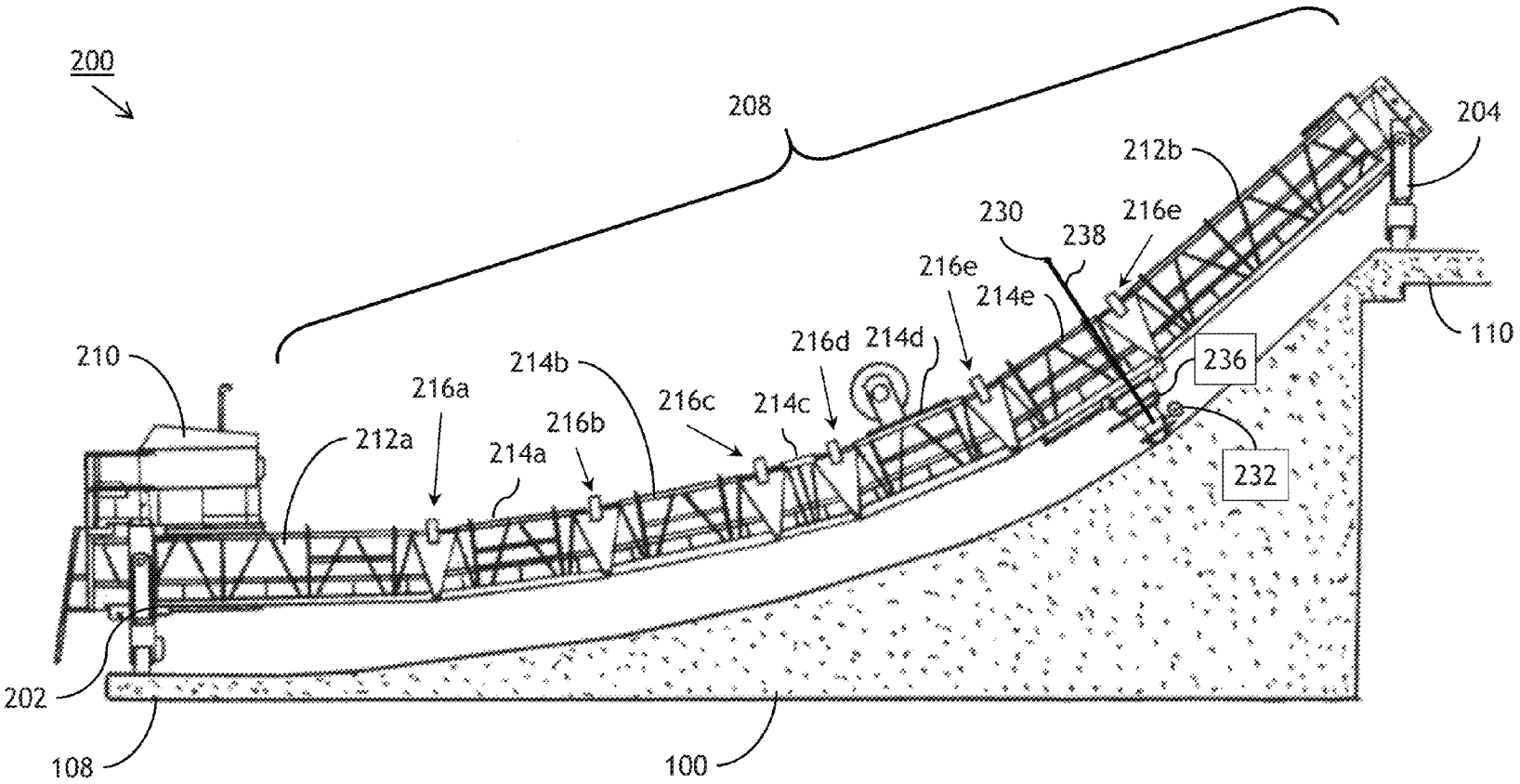

The position sensors 230 may further include elevation sensors 230*a* fixed to the inside end car 202 and the outside end car 204, which continually return information about the relative height of both end cars 202, 204 to the control system 220. The control system 220 may correlate elevation data from both end cars 202, 204 with the surface profile 222 to confirm the position of the finishing machine 200. Furthermore, as continuous travel along the transition curve 106 and the banked curve 104 may result in a significant superelevation, and therefore a significant difference in elevation between the inside end car 202 and the outside end car 204, the outside end car 204 may be hingedly or pivotably connected (204*a*) to the rigid frame member 212*b* of the transverse frame 208. As the slope or curvature of the paved surface 100 increases, and the PTAs 216 (particularly PTAs 216*e*, 216*f*) change the shape of the transverse frame 208 to conform to the curvature of the paved surface 100, the rigid frame member 212*b* may become oriented further and further inward as the transverse frame 208 assumes an increasingly concave shape to match the increasing transverse curve near the outside edge 110. As the outside end car 204 is pivotably connected to the transverse frame 208, the outside end car 204 may retain its vertical orientation regardless of any changes in shape or orientation to the transverse frame 208. For example, as shown by FIG. 2C, the slope sensor 230 may report an orientation of the finishing machine 200 near the outside edge 110 that both represents a significant departure from the "baseline" vertical orientation of the mast 238 (as shown by FIG. 2A) and may change from point to point due to the significant transverse curvature of the paved surface 100.

In one embodiment, the accessory 232 includes a finishing cylinder with a finishing edge (ex.—finishing surface) in contact with the paved surface 100. For example, the control system 220 may position the finishing edge at a consistent depth relative to the paved surface 100 by raising or lowering the height of the undercarriage 234 to which the finishing cylinder 232 is mounted. As the transverse curvature of the paved surface 100 steepens (as shown by FIG. 2C) the control system may additionally control the precise orientation of the finishing cylinder 232 and the finishing edge by articulating the one or more PTAs 216 to bend the transverse frame 208 to more precisely conform to the transverse curvature of the paved surface 100, while articulating the cylinder finisher 232 laterally across the transverse frame 208.

Referring back to FIG. 1, the finishing machine may reach a point 126 where the transition curve 106 meets the banked curve 104. Referring also to FIG. 2C, at point 126 the superelevation of the paved surface 100 may be at or near its maximum. Consequently, as the finishing machine 200 progresses from point 124 (as shown by FIG. 2B) to point 126 (as shown by FIG. 2C), the control system 220 may continue to articulate the one or more PTAs 216 to adjust the shape of the transverse frame 208 to conform to the increased curvature of the paved surface 100. Should the banked curve 104 (between points 116 and 120) be characterized by a more consistent curve, and a more consistent transverse slope, compared to the transition curve 106, the control system 220 may instead adjust the height of the undercarriage 234 to conform to the paved surface 100 rather than articulating the PTAs 216 in response to a continually changing transverse curvature.

Figure 4:
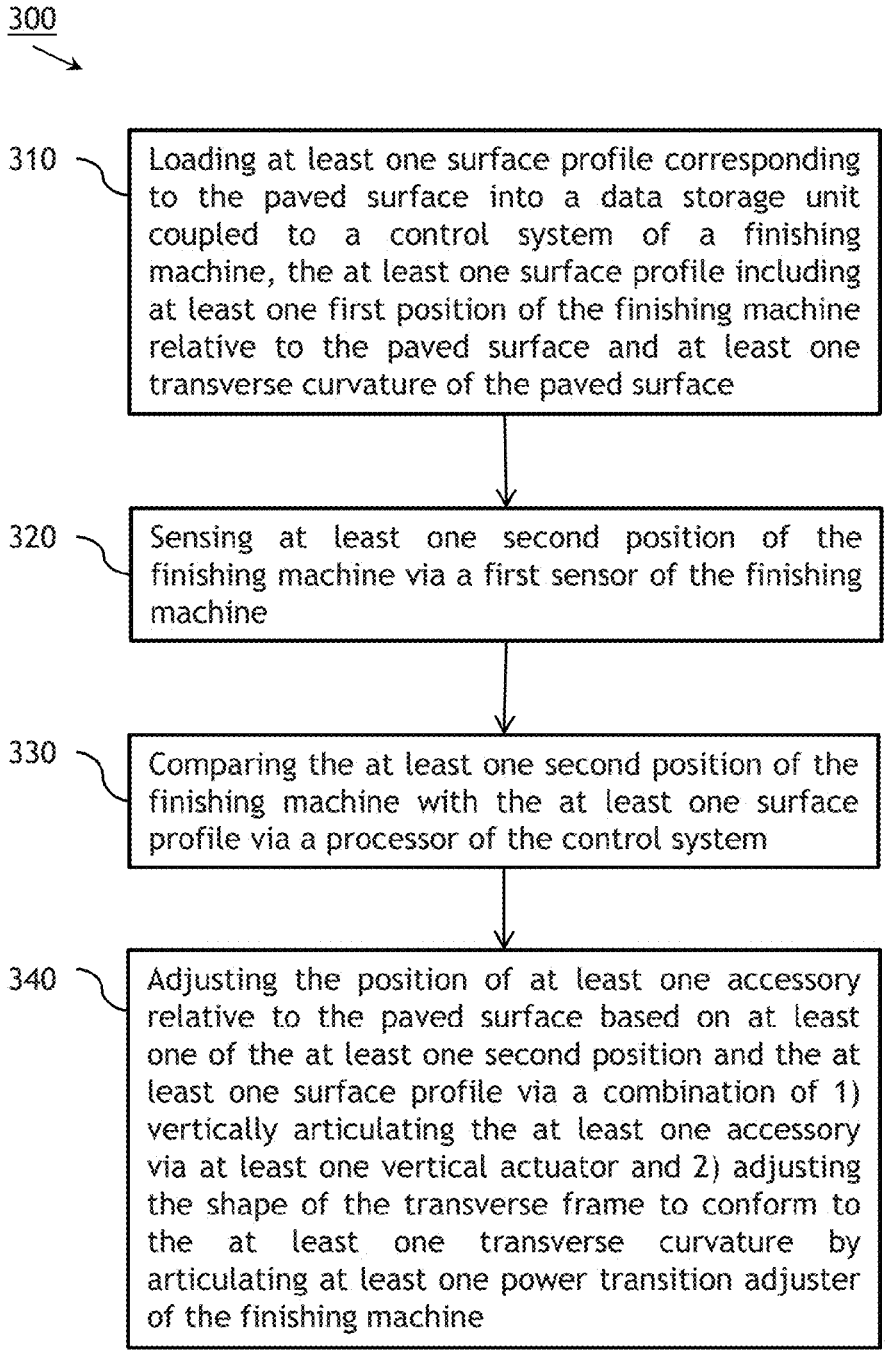
FIG. 4 is a process flow diagram illustrating a method according to embodiments of the present disclosure.

FIG. 4 is a process flow diagram of a method 300 for finishing a paved surface 100 according to embodiments of the present disclosure. It is noted herein that the method 300 may be carried out utilizing any of the embodiments described previously. It is further noted, however, that method 300 is not limited to the components or configurations described previously as multiple components and/or configurations may be suitable for executing method 300.

At a step 310, at least one surface profile 222 corresponding to the paved surface 100 is loaded into a data storage unit 226 coupled to a control system 220 of a finishing machine 200, the at least one surface profile 222 including at least one first position of the finishing machine 200 relative to the paved surface 100 and at least one transverse curvature of the paved surface 100.

At a step 320, a first sensor 230 senses at least one position of the finishing machine 200. For example, a GNSS receiver 230 may sense an absolute position of the finishing machine 200. In addition, an elevation sensor 230*a* may sense an elevation of the inside end car 202 or the outside end car 204. Furthermore, the control system 220 may determine a superelevation of the paved surface 100 corresponding to the absolute position of the finishing machine 200 based on the sensed elevation of the inside end car 202 or the outside end car 204. In addition, a slope sensor 230 may sense at least one of a pitch angle and a roll angle of the finishing machine 200, or determine a relative position of the finishing machine 200 based on the pitch angle or the roll angle.

At a step 330, a processor 228 of the control system 220 compares the at least one sensed position of the finishing machine 200 with the at least one surface profile 222. For example, the processor 228 of the control system 220 may compare at least one of the sensed elevation of the inside end car 202, the sensed elevation of the outside end car 204, and the determined superelevation of the paved surface 100 with the at least one surface profile 222.

At a step 340, the control system 220 adjusts the position of at least one accessory 232 relative to the paved surface 100 based on at least one of the at least one second position and the at least one surface profile 222. For example, the control system may raise or lower the at least one accessory 232 via at least one vertical actuator 236. In addition, the control system 220 may articulate at least one power transition adjuster 216 of the finishing machine 200 to adjust the shape of a plurality of flexibly connected frame members 212, 214 of the transverse frame 208 to conform to a transverse curvature of the paved surface 100. The control system 220 may further laterally articulate the at least one accessory 232 along the transverse frame 208.

We claim:

1. An apparatus for finishing a paved surface, the paved surface having an inside edge and an outside edge, the apparatus comprising:

a control system including at least one processor and at least one data storage unit configured to store at least one surface profile, the at least one surface profile including at least one first position of the apparatus relative to the paved surface, at least one slope of the paved surface, and at least one transverse curvature of the paved surface;

at least one sensor coupled to the control system, the at least one sensor configured to sense at least one second position of the apparatus;

a first end car associated with the inside edge;

a second end car associated with the outside edge;

a transverse frame connecting the first end car and the second end car, the transverse frame including a plurality of frame members, the plurality of frame members flexibly connected in series by at least one power transition adjuster coupled to the control system;

an undercarriage slidably coupled to the transverse frame, the undercarriage including at least one vertical actuator coupled to the control system; and at least one accessory coupled to the undercarriage;

the control system configured to receive the at least one second position of the apparatus from the at least one sensor;

compare the at least one second position of the apparatus to the at least one surface profile;

adjust the position of the at least one accessory relative to the paved surface according to at least one of the at least one second position of the apparatus and the at least one surface profile via a combination of 1) raising or lowering the undercarriage by actuating the at least one vertical actuator and 2) adjusting the shape of the transverse frame to conform to the at least one transverse curvature by actuating the at least one power transition adjuster.

2. The apparatus of claim 1, wherein the at least one accessory includes a cylinder finisher having at least one finishing edge configured to contact the paved surface.

3. The apparatus of claim 1, wherein the at least one sensor includes a GNSS receiver configured to sense an absolute position of the finishing machine.

4. The apparatus of claim 1, wherein the at least one sensor includes a second elevation sensor configured to sense at least one of a second elevation of the first end car and a third elevation of the second end car.

5. The apparatus of claim 1, wherein the at least one sensor includes a slope sensor configured to sense at least one of a pitch angle of the machine and a roll angle of the machine.

6. The apparatus of claim 5, wherein the at least one second position of the apparatus includes a relative position of the apparatus.

7. The apparatus of claim 1, wherein the at least one vertical actuator includes a hydraulic cylinder.

8. The apparatus of claim 1, wherein the transverse frame includes at least one rail;

the undercarriage is slidably connected to the at least one rail; and the control system is configured to transversely articulate the undercarriage according to the at least one of the at least one second position of the apparatus and the at least one surface profile.

9. The apparatus of claim 1, wherein the first end car is slidably coupled to the transverse frame; and the second end car is pivotably coupled to the transverse frame.

10. A method for finishing a paved surface via a finishing machine having a transverse frame, the method comprising:

loading at least one surface profile corresponding to the paved surface into a data storage unit coupled to a control system of a finishing machine, the at least one surface profile including at least one of a first position of the finishing machine relative to the paved surface, a slope of the paved surface, and a transverse curvature of the paved surface;

sensing at least one second position of the finishing machine via a sensor of the finishing machine;

comparing the at least one second position of the finishing machine with the at least one surface profile via at least one processor of the control system;

adjusting a third position of at least one accessory relative to the paved surface based on at least one of the at least one second position and the at least one surface profile via a combination of 1) vertically articulating the at least one accessory via at least one vertical actuator and 2) adjusting the shape of the transverse frame to conform to the at least one transverse curvature by articulating at least one power transition adjuster of the finishing machine.

11. The method of claim 10, wherein sensing at least one second position of the finishing machine via a sensor of the finishing machine includes at least one of sensing a first elevation of a first end car of the finishing machine via at least one first elevation sensor, the first end car associated with an inside edge of the paved surface;

sensing a second elevation of a second end car of the finishing machine via at least one second elevation sensor, the second end car associated with an outside edge of the paved surface;

determining a first superelevation corresponding to the second position of the finishing machine based on at least one of the first elevation and the second elevation.

12. The method of claim 11, wherein comparing the at least one second position of the finishing machine with the at least one surface profile via at least one processor of the control system includes:

comparing at least one of the first elevation, the second elevation, and the first superelevation with the at least one surface profile via at least one processor of the control system.

13. The method of claim 10, wherein sensing at least one second position of the finishing machine via a sensor of the finishing machine includes:

sensing at least one of a pitch angle of the machine and a roll angle of the machine via at least one slope sensor of the finishing machine.

14. The method of claim 13, wherein sensing at least one second position of the finishing machine via a sensor of the finishing machine includes:

sensing at least one relative position of the finishing machine based on at least one of the at least one pitch angle and the at least one roll angle.

15. The method of claim 10, wherein sensing at least one second position of the finishing machine via a sensor of the finishing machine includes:

sensing at least one absolute position of the finishing machine via a GNSS receiver of the finishing machine.

16. The method of claim 10, wherein adjusting a third position of at least one accessory relative to the paved surface based on at least one of the at least one second position and the at least one surface profile via a combination of 1) vertically articulating the at least one accessory via at least one vertical actuator and 2) adjusting the shape of the transverse frame to conform to the at least one transverse curvature by articulating at least one power transition adjuster of the finishing machine includes:

adjusting a third position of at least one accessory relative to the paved surface based on at least one of the at least one second position and the at least one surface profile via a combination of 1) vertically articulating the at least one accessory via at least one vertical actuator and 2) adjusting the shape of the transverse frame to conform to the at least one transverse curvature by articulating at least one power transition adjuster of the finishing machine to adjust the shape of a plurality of flexibly connected frame members.

17. The method of claim 10, wherein adjusting a third position of at least one accessory relative to the paved surface based on at least one of the at least one second position and the at least one surface profile via a combination of 1) vertically articulating the at least one accessory via at least one vertical actuator and 2) adjusting the shape of the transverse frame to conform to the at least one transverse curvature by articulating at least one power transition adjuster of the finishing machine includes:

adjusting a third position of at least one accessory relative to the paved surface based on at least one of the at least one second position and the at least one surface profile via a combination of 1) vertically articulating the at least one accessory via at least one vertical actuator, 2) adjusting the shape of the transverse frame to conform to the at least one transverse curvature by articulating at least one power transition adjuster of the finishing machine, and 3) laterally articulating the at least one accessory along the transverse frame.

* * * * *